US012789040B2

(12) United States Patent
Lee

(10) Patent No.: US 12,789,040 B2
(45) Date of Patent: Nov. 10, 2026

(54) METHOD AND DEVICE FOR ESTIMATING INFORMATION ABOUT GOLF SWING, AND NON-TRANSITORY COMPUTER-READABLE RECORDING MEDIUM

(71) Applicant: MOAIS, INC., Seoul (KR)

(72) Inventor: Yong Geun Lee, Seoul (KR)

(73) Assignee: MOAIS, INC., Seoul (KR)

( * ) Notice: Subject to any disclaimer, the term of this patent is extended or adjusted under 35 U.S.C. 154(b) by 627 days.

(21) Appl. No.: 18/271,070

(22) PCT Filed: Jan. 3, 2022

(86) PCT No.: PCT/KR2022/000009
§ 371 (c)(1),
(2) Date: Jul. 10, 2023

(87) PCT Pub. No.: WO2022/149811
PCT Pub. Date: Jul. 14, 2022

(65) Prior Publication Data

US 2024/0299803 A1 Sep. 12, 2024

(30) Foreign Application Priority Data

Jan. 8, 2021 (KR) ..... 10-2021-0002920

(51) Int. Cl.
*A63B 24/00* (2006.01)

(52) U.S. Cl.
CPC ..... *A63B 24/0003* (2013.01); *A63B 24/0021* (2013.01); *A63B 2024/0025* (2013.01); *A63B 2220/05* (2013.01); *A63B 2220/806* (2013.01)

(58) Field of Classification Search
CPC ..... A63B 24/0003; A63B 2220/807; A63B 2102/32; G09B 19/0038; G09B 19/003
See application file for complete search history.

(56) References Cited

U.S. PATENT DOCUMENTS 6,506,124 B1 * 1/2003 Manwaring ..... A63B 69/3605 473/409
2005/0215336 A1 * 9/2005 Ueda ..... A63B 24/0003 473/131

FOREIGN PATENT DOCUMENTS

JP 2004024488 A 1/2004
JP 2004061483 A 2/2004
(Continued)

OTHER PUBLICATIONS

Mao et al. "Fast and Efficient Non-Contact Ball Detector for Picking Robots" in IEEE Access, vol. 7, pp. 175487-175498, 2019, doi: 10.1109/ACCESS.2019.2955834. (Year: 2020).*

*Primary Examiner* — Robert J Utama
(74) *Attorney, Agent, or Firm* — Dinsmore & Shohl LLP; Yongsok Choi, Esq.

(57) ABSTRACT

A method for estimating information on a golf swing is provided. The method includes the steps of: detecting, when a photographed image of a user's golf swing is acquired, at least one of a plurality of key points for a shaft of a club and a plurality of key points for a face of the club, and at least one joint of the user from the photographed image using an artificial neural network model; and estimating a posture of the club on the basis of at least one of positions of the plurality of key points for the shaft and positions of the plurality of key points for the face, and estimating information on the user's golf swing with reference to the posture of the club and a position of the at least one joint of the user.

11 Claims, 4 Drawing Sheets

(56) References Cited

FOREIGN PATENT DOCUMENTS

| | | | | | |
|---|---|---|---|---|---|
| JP | 2007167549 | A | | 7/2007 | |
| JP | 2014079473 | A | | 5/2014 | |
| JP | 2019016106 | A | | 1/2019 | |
| JP | 2019036009 | A | | 3/2019 | |
| JP | 2019166311 | A | | 10/2019 | |
| JP | 2020119568 | A | | 8/2020 | |
| KR | 1020160121379 | A | | 10/2016 | |
| KR | 1020200115729 | A | | 10/2020 | |
| KR | 1020200145067 | A | | 12/2020 | |
| WO | WO-2009060011 | A2 | * | 5/2009 | ..... A63B 24/0006 |
| WO | 2019079895 | A | | 5/2019 | |

* cited by examiner

METHOD AND DEVICE FOR ESTIMATING INFORMATION ABOUT GOLF SWING, AND NON-TRANSITORY COMPUTER-READABLE RECORDING MEDIUM

CROSS-REFERENCE TO RELATED APPLICATION(S)

This application is a national phase of Patent Cooperation Treaty (PCT) International Application No. PCT/KR2022/000009 filed on Jan. 3, 2022, which claims priority to Korean Patent Application No. 10-2021-0002920 filed on Jan. 8, 2021. The entire contents of PCT International Application No. PCT/KR2022/000009 and Korean Patent Application No. 10-2021-0002920 are hereby incorporated by reference.

FIELD OF THE INVENTION

The present invention relates to a method, device, and non-transitory computer-readable recording medium for estimating information on a golf swing.

BACKGROUND

In recent years, techniques for analyzing images of a golfer's swing and providing useful information to the golfer have been introduced.

As an example of related conventional techniques, Korean Laid-Open Patent Publication No. 2009-105031 discloses a golf clinic system employing image processing techniques and an operation method thereof, the system comprising: a plurality of markers attached to a body and a golf club of a golf practitioner; a plurality of cameras for collecting images of a swing motion of the golf practitioner; an image analyzer for reconstructing two-dimensional images collected from the plurality of cameras into three-dimensional images, extracting spatial coordinates of the markers according to movements, and analyzing angular values of parts of the body and data for each stage in real time to output a clinic result in a report format; and a database in which kinematic clinic information on the swing motion is matched with member information and stored as digital data.

However, according to the techniques introduced so far as well as the above-described conventional technique, it is necessary to separately use an expensive instrument for recognizing a golfer's posture and motion, or to attach separate sensors (or markers) to the golfer's body and golf club, in order to analyze the golfer's swing.

SUMMARY OF THE INVENTION

One object of the present invention is to solve all the above-described problems in prior art.

Another object of the invention is to detect, when a photographed image of a user's golf swing is acquired, at least one of a plurality of key points for a shaft of a club and a plurality of key points for a face of the club, and at least one joint of the user from the photographed image using an artificial neural network model, and to estimate a posture of the club on the basis of at least one of positions of the plurality of key points for the shaft and positions of the plurality of key points for the face, and estimate information on the user's golf swing with reference to the posture of the club and a position of the at least one joint of the user.

Yet another object of the invention is to light-weight an artificial neural network model using depthwise convolution and pointwise convolution, and estimate a posture of a club and information on a user's golf swing from a photographed image of the user's golf swing using the light-weighted artificial neural network model.

Still another object of the invention is to estimate information on a user's golf swing with reference to a posture of a club estimated from a photographed image of the user's golf swing as well as a position of at least one joint of the user.

The representative configurations of the invention to achieve the above objects are described below.

According to one aspect of the invention, there is provided a method comprising the steps of: detecting, when a photographed image of a user's golf swing is acquired, at least one of a plurality of key points for a shaft of a club and a plurality of key points for a face of the club, and at least one joint of the user from the photographed image using an artificial neural network model; and estimating a posture of the club on the basis of at least one of positions of the plurality of key points for the shaft and positions of the plurality of key points for the face, and estimating information on the user's golf swing with reference to the posture of the club and a position of the at least one joint of the user.

According to another aspect of the invention, there is provided a device comprising: a club and joint detection unit configured to detect, when a photographed image of a user's golf swing is acquired, at least one of a plurality of key points for a shaft of a club and a plurality of key points for a face of the club, and at least one joint of the user from the photographed image using an artificial neural network model; and a golf swing information estimation unit configured to estimate a posture of the club on the basis of at least one of positions of the plurality of key points for the shaft and positions of the plurality of key points for the face, and estimate information on the user's golf swing with reference to the posture of the club and a position of the at least one joint of the user.

In addition, there are further provided other methods and devices to implement the invention, as well as non-transitory computer-readable recording media having stored thereon computer programs for executing the methods.

According to the invention, it is possible to detect, when a photographed image of a user's golf swing is acquired, at least one of a plurality of key points for a shaft of a club and a plurality of key points for a face of the club, and at least one joint of the user from the photographed image using an artificial neural network model, and to estimate a posture of the club on the basis of at least one of positions of the plurality of key points for the shaft and positions of the plurality of key points for the face, and estimate information on the user's golf swing with reference to the posture of the club and a position of the at least one joint of the user, thereby estimating the information on the user's golf swing only with the photographed image, without using any separate sensor (or marker) or instrument.

According to the invention, it is possible to light-weight an artificial neural network model using depthwise convolution and pointwise convolution, and estimate a posture of a club from a photographed image of a user's golf swing using the light-weighted artificial neural network model, thereby accurately and efficiently estimating information on the user's golf swing in a mobile device, without using any separate sensor (or marker) or instrument.

According to the invention, it is possible to estimate information on a user's golf swing with reference to a posture of a club estimated from a photographed image of the user's golf swing as well as a position of at least one joint of the user, thereby estimating information that is difficult to identify only from the position of the at least one joint of the user (e.g., information on wrist control and/or club control).

EXPLANATION ON REFERENCE NUMBERS

Figure 1:
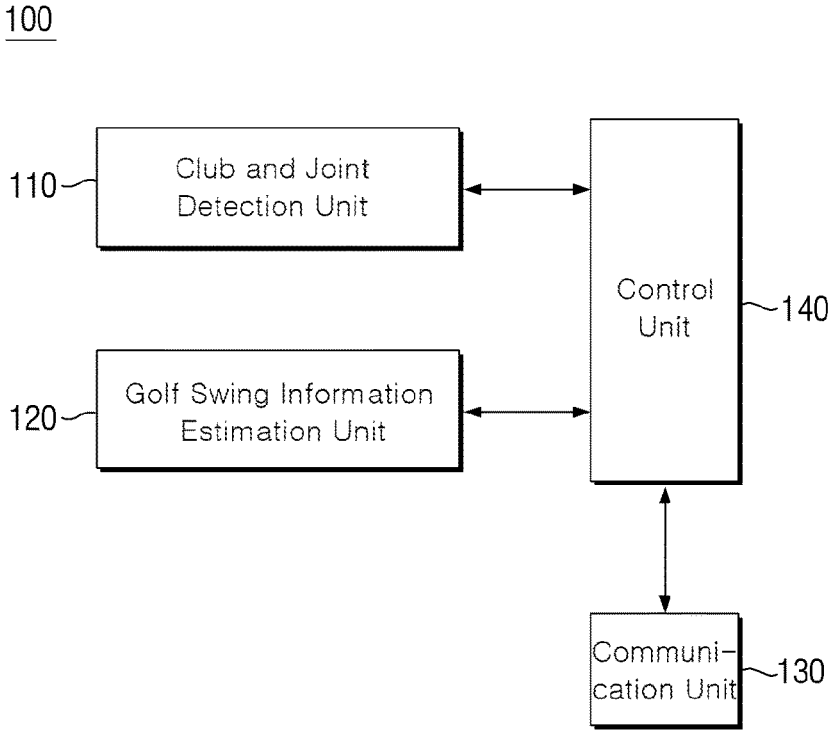
FIG. 1 specifically shows the internal configuration of a device according to one embodiment of the invention.

100: device
110: club and joint detection unit
120: golf swing information estimation
130: communication unit
140: control unit

DETAILED DESCRIPTION

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures, and characteristics described herein may be implemented as modified from one embodiment to another without departing from the spirit and scope of the invention. Furthermore, it shall be understood that the positions or arrangements of individual elements within each embodiment may also be modified without departing from the spirit and scope of the invention. Therefore, the following detailed description is not to be taken in a limiting sense, and the scope of the invention is to be taken as encompassing the scope of the appended claims and all equivalents thereof. In the drawings, like reference numerals refer to the same or similar elements throughout the several views.

Hereinafter, various preferred embodiments of the present invention will be described in detail with reference to the accompanying drawings to enable those skilled in the art to easily implement the invention.

Although embodiments related to a golf swing are described herein focusing on a full swing, the golf swing according to the invention should be understood in the broadest sense as encompassing all motions for moving a golf club. For example, the golf swing according to one embodiment of the invention may include a full swing, a half swing, a chip shot, a lobe shot, and a putt.

Configuration of a Device

Hereinafter, the internal configuration of a device 100 crucial for implementing the invention and the functions of the respective components thereof will be discussed.

FIG. 1 specifically shows the internal configuration of the device 100 according to one embodiment of the invention.

As shown in FIG. 1, the device 100 according to one embodiment of the invention may comprise a club and joint detection unit 110, a golf swing information estimation unit 120, a communication unit 130, and a control unit 140. According to one embodiment of the invention, at least some of the club and joint detection unit 110, the golf swing information estimation unit 120, the communication unit 130, and the control unit 140 may be program modules to communicate with an external system (not shown). The program modules may be included in the device 100 in the form of operating systems, application program modules, or other program modules, while they may be physically stored in a variety of commonly known storage devices. Further, the program modules may also be stored in a remote storage device that may communicate with the device 100. Meanwhile, such program modules may include, but are not limited to, routines, subroutines, programs, objects, components, data structures, and the like for performing specific tasks or executing specific abstract data types as will be described below in accordance with the invention.

Meanwhile, the above description is illustrative although the device 100 has been described as above, and it will be apparent to those skilled in the art that at least a part of the components or functions of the device 100 may be implemented in a server (not shown) or included in an external system (not shown), as necessary.

Meanwhile, the device 100 according to one embodiment of the invention is digital equipment having a memory means and a microprocessor for computing capabilities, and may include smart phones, tablets, smart watches, smart bands, smart glasses, desktop computers, notebook computers, workstations, personal digital assistants (PDAs), web pads, and mobile phones. However, the device 100 is not limited to the examples mentioned above, and may be changed without limitation as long as the objects of the invention may be achieved.

In particular, the device 100 may include an application (not shown) for assisting a user to receive services such as estimation of information on a golf swing from the device 100. The application may be downloaded from an external application distribution server (not shown). Meanwhile, the characteristics of the application may be generally similar to those of the club and joint detection unit 110, the golf swing information estimation unit 120, the communication unit 130, and the control unit 140 of the device 100 to be described below. Here, at least a part of the application may be replaced with a hardware device or a firmware device that may perform a substantially equal or equivalent function, as necessary.

First, the club and joint detection unit 110 according to one embodiment of the invention may function to detect, when a photographed image of a user's golf swing is acquired, at least one of a plurality of key points for a shaft of a club and a plurality of key points for a face of the club, and at least one joint of the user from the photographed image using an artificial neural network model.

Specifically, according to one embodiment of the invention, the photographed image of the user's golf swing may be photographed by the device 100, or may be photographed by another device (not shown) and acquired by the device 100. Further, according to one embodiment of the invention, the photographed image of the user's golf swing may be an image photographed by an RGB camera. That is, the club and joint detection unit 110 according to one embodiment of the invention may detect at least one of the plurality of key points for the shaft of the club and the plurality of key points for the face of the club, and the at least one joint of the user using only the RGB image of the user's golf swing, without using depth information acquired from an instrument such as a depth camera or a depth sensor, and sensors (or markers) attached to the user's body or the golf club. Meanwhile, the photographed image of the user's golf swing according to the invention mainly refers to a moving picture, but should be understood in the broadest sense as encompassing all data that may represent a user's golf swing in visual forms regardless of their formats.

Further, the club and joint detection unit 110 according to one embodiment of the invention may function to derive probability information on positions of at least one of the plurality of key points for the shaft of the club and the plurality of key points for the face of the club, and probability information on a position of the at least one joint of the user from the photographed image of the user's golf swing using the artificial neural network model.

Specifically, the probability information on the positions of the plurality of key points for the shaft of the club, the probability information on the positions of the plurality of key points for the face of the club, and the probability information on the position of the at least one joint of the user, which may be derived by the club and joint detection unit 110 according to one embodiment of the invention, may be included in a probability map (i.e., output data of the artificial neural network model) generated by using the photographed image of the user's golf swing as input data of the artificial neural network model.

For example, according to one embodiment of the invention, the probability map may be a two-dimensional heat map. Further, the club and joint detection unit 110 according to one embodiment of the invention may generate at least one two-dimensional heat map image for each of the at least one joint of the user using the artificial neural network model, and may derive the probability information on the two-dimensional position of the at least one joint of the user on the basis of properties such as the two-dimensional position of the at least one joint being more likely to correspond to pixels with larger values, among pixels constituting the generated at least one heat map image, or the position of the at least one joint being less likely to be accurately specified as pixels with small values are widely distributed in the heat map, and being more likely to be accurately specified as pixels with large values are narrowly distributed in the heat map. Furthermore, the club and joint detection unit 110 according to one embodiment of the invention may determine the two-dimensional position of the at least one joint of the user with reference to the derived probability information, and detect the at least one joint of the user as the determined position.

Meanwhile, the above-described manner of deriving the probability information on the position of the at least one joint of the user may be similarly applied to the case where the club and joint detection unit 110 according to one embodiment of the invention detects the plurality of key points for the shaft of the club and/or the plurality of key points for the face of the club (i.e., at least one two-dimensional heat map image may be generated for each of the plurality of key points), and thus a detailed description thereof will be omitted.

Meanwhile, the artificial neural network model according to one embodiment of the invention may include, for example, a convolutional neural network (CNN) model, a recurrent neural network (RNN) model, a deep belief network (DBN) model, or an artificial neural network model in which the foregoing models are combined. However, the artificial neural network model according to one embodiment of the invention is not limited to those mentioned above, and may be diversely changed as long as the objects of the invention may be achieved.

Further, the artificial neural network model according to one embodiment of the invention may be a model that is light-weighted using depthwise convolution and pointwise convolution.

In addition, the artificial neural network model according to one embodiment of the invention may be a model that is light-weighted using a light-weighting algorithm such as pruning, weight quantization, and residual learning. Further, the artificial neural network model according to one embodiment of the invention may be a model with an encoder-decoder structure, wherein the decoder may be composed of a very small number of channels and layers compared to the encoder for the light-weighting.

Specifically, since artificial neural network models commonly used in object recognition technology require a high level of computing resources to be consumed for a high level of recognition performance, it is often difficult to use such models in environments where only limited computing resources are provided (e.g., mobile devices). Therefore, according to one embodiment of the invention, an artificial neural network model may be light-weighted using depthwise convolution and pointwise convolution, and the light-weighted artificial neural network model may be used in a mobile device so that at least one of a plurality of key points for a shaft of a club and a plurality of key points for a face of the club, and at least one joint of a user may be detected from a photographed image of the user's golf swing.

Here, the depthwise convolution according to one embodiment of the invention may refer to a convolution process in which a kernel is applied for each depth (i.e., each channel) of an input layer, in performing convolution in the artificial neural network model according to one embodiment of the invention. Meanwhile, since the method of operation using the applied kernel is the same as that of general convolution, a detailed description thereof will be omitted.

Further, the pointwise convolution according to one embodiment of the invention may refer to a convolution process in which a kernel of size $1\times1\times M$ (i.e., a kernel of width 1, height 1, and depth M) is applied for each point of an input layer, in performing convolution in the artificial neural network model according to one embodiment of the invention.

Figure 2A:
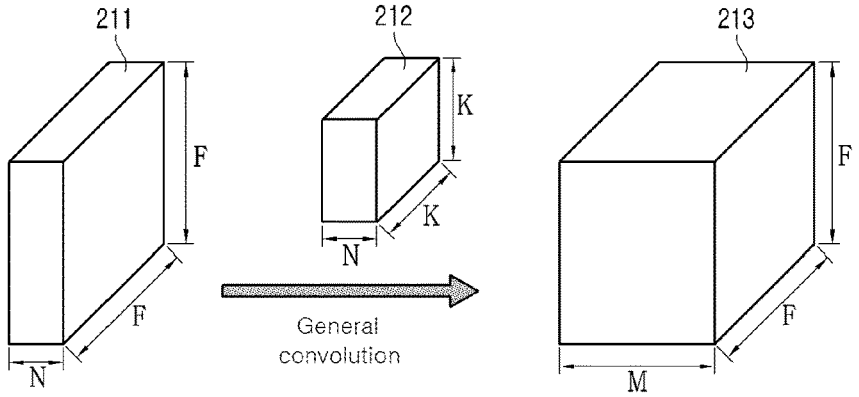
FIG. 2A illustratively shows how general convolution is performed according to one embodiment of the invention.

FIG. 2A illustratively shows how general convolution is performed according to one embodiment of the invention.

Figure 2B:
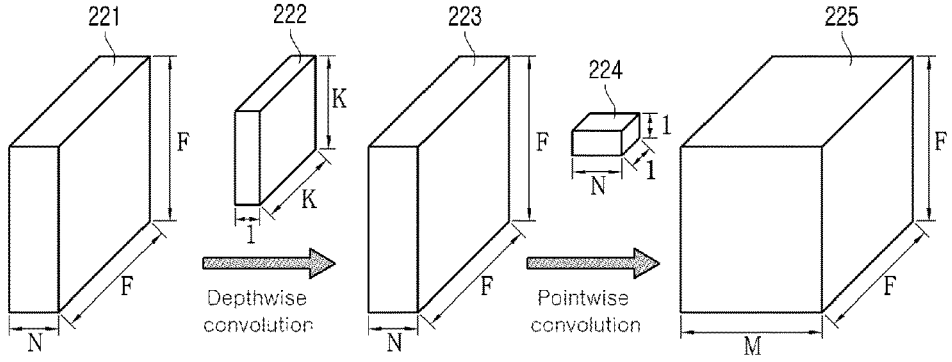
FIG. 2B illustratively shows how depthwise convolution and pointwise convolution are performed according to one embodiment of the invention.

FIG. 2B illustratively shows how depthwise convolution and pointwise convolution are performed according to one embodiment of the invention.

Referring to FIG. 2A, according to one embodiment of the invention, it may be assumed that the width, height, and depth of an input layer 211 are F, F, and N, respectively; the width, height, and depth of each kernel 212 are K, K, and N, respectively; and the width, height, and depth of an output layer 213 are F, F, and M, respectively. Here, it is assumed that padding and stride are appropriately sized such that there is no change in the width and height of the input layer 211 and the output layer 213. In this case, in the general convolution, the kernel 212 is applied to the input layer 211 to constitute one depth of the output layer 213 (through F×F×K×K×N operations), and these operations are performed for M kernels 212 so that a total of F×F×K×K×N×M operations are performed.

Referring to FIG. 2B, according to one embodiment of the invention, it may be assumed that the width, height, and depth of an input layer 221 are F, F, and N, respectively; the width, height, and depth of each kernel 222 in the depthwise convolution are K, K, and 1, respectively; the width, height, and depth of each kernel 224 in the pointwise convolution are 1, 1, and N, respectively; and the width, height and depth of an output layer 225 are F, F, and M, respectively. In this case, the kernel 222 is applied for each depth of the input layer 221 to constitute each depth of an intermediate layer 223 (through F×F×K×K×1×N operations). Then, the kernel 224 is applied for each point of the intermediate layer 223 to constitute one depth of the output layer 225 (through F×F×1×1×N operations), and these operations are performed for M kernels 224 so that a total of F×F×1×1×N×M operations are performed in the pointwise convolution. Therefore, according to one embodiment of the invention, a total of (F×F×K×K×1×N)+(F×F×1×1×N×M) operations are performed in the depthwise convolution and the pointwise convolution, so that the amount of operations is reduced compared to the general convolution.

Meanwhile, the light-weighting algorithms according to one embodiment of the invention are not necessarily limited to the above algorithms (i.e., the depthwise convolution and the pointwise convolution), and the order or number of times of applying each of the above algorithms may also be diversely changed.

Meanwhile, according to one embodiment of the invention, the plurality of key points for the shaft of the club may include at least two of an arbitrary point located at an upper part of the shaft of the club, an arbitrary point located at a lower part of the shaft of the club, and a point between the arbitrary point located at the upper part and the arbitrary point located at the lower part.

Figure 3A:
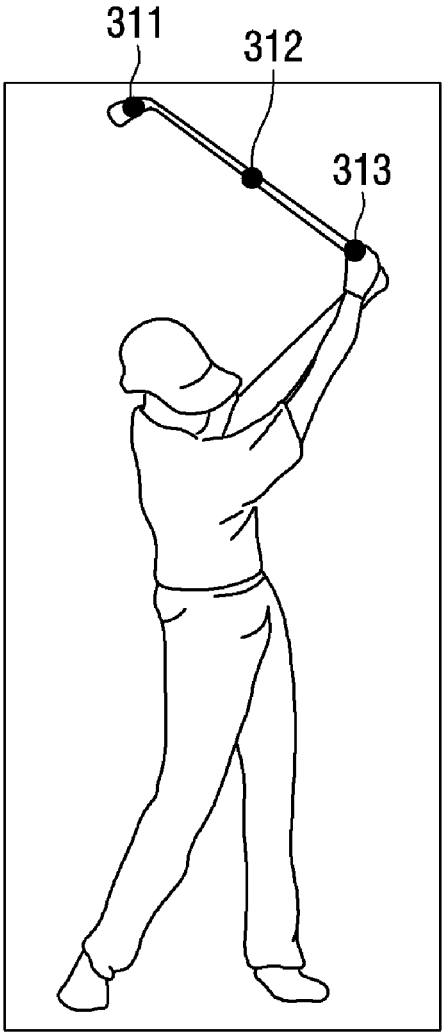
FIG. 3A illustratively shows how to estimate a posture of a club and information on a user's golf swing according to one embodiment of the invention.
Figure 3B:
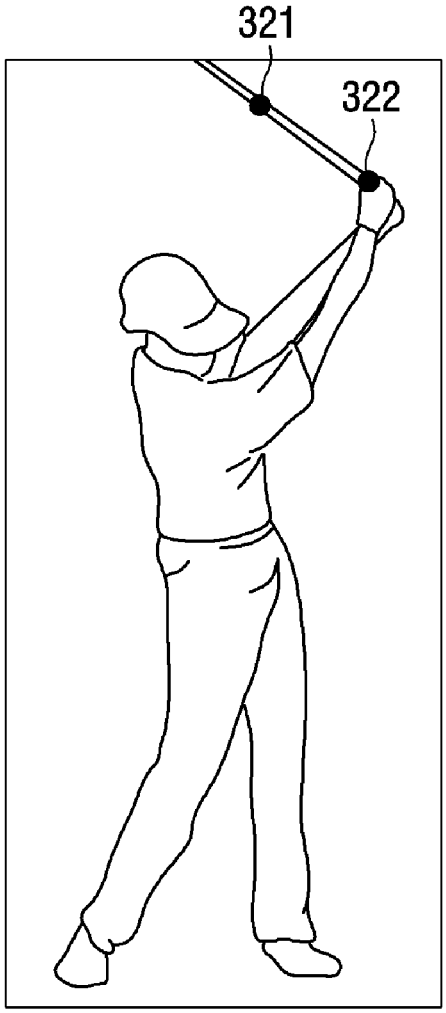
FIG. 3B illustratively shows how to estimate a posture of a club and information on a user's golf swing according to one embodiment of the invention.

FIGS. 3A and 3B illustratively show how to estimate a posture of a club and information on a user's golf swing according to one embodiment of the invention.

For example, according to one embodiment of the invention, referring to FIG. 3A, a plurality of key points for a shaft of the club may include an arbitrary point 313 (i.e., a handle part of the club) located at an upper part of the shaft of the club, an arbitrary point 311 (i.e., a head part of the club) located at a lower part of the shaft, and a middle point 312 of the arbitrary point 313 located at the upper part and the arbitrary point 311 located at the lower part (i.e., a middle point of the shaft of the club).

As another example, according to one embodiment of the invention, referring to FIG. 3B, it may be assumed that a photographed image of the user's golf swing does not contain a part of the club (e.g., a head part of the club). In this case, according to one embodiment of the invention, a plurality of key points for a shaft of the club may include an arbitrary point 322 (i.e., a handle part of the club) located on an upper part of the shaft of the club and a middle point 321 of the shaft of the club.

However, the plurality of key points for the shaft of the club according to one embodiment of the invention are not limited to the foregoing, and may be diversely changed as long as the objects of the invention may be achieved.

Further, according to one embodiment of the invention, a plurality of key points for a face of the club may include at least three points that allow a posture of the face to be estimated. According to one embodiment of the invention, the posture of the face of the club may include, but is not limited to, an orientation of the face, an angle formed by the face and a specific reference line (e.g., a reference line for the user's body), and a degree to which the club is open and closed during the golf swing.

Figure 4:
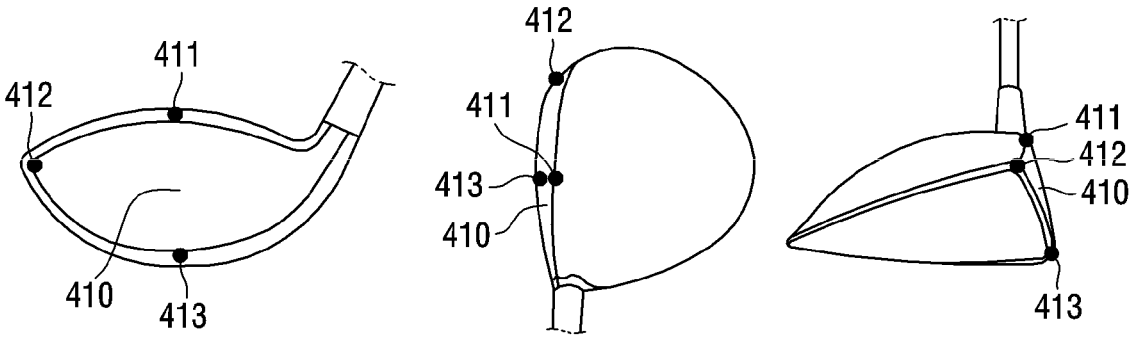
FIG. 4 illustratively shows how to estimate a posture of a club and information on a user's golf swing according to one embodiment of the invention.

FIG. 4 illustratively shows how to estimate a posture of a club and information on a user's golf swing according to one embodiment of the invention.

For example, according to one embodiment of the invention, referring to FIG. 4, a plurality of key points for a face 410 of the club may include a middle point 411 of a line forming an upper end of the club face 410 (or an upper end 411 of the club face), a middle point 413 of a line forming a lower end of the club face 410 (or a lower end 413 of the club face), and a middle point 412 of a line forming an outer side of the club face 410 (or an outermost side 412 of the club face).

However, the plurality of key points for the face of the club according to one embodiment of the invention are not limited to the foregoing, and may be diversely changed as long as the objects of the invention may be achieved, unless a posture of the face of the club cannot be estimated (e.g., unless the plurality of key points for the face of the club form a straight line).

Meanwhile, the club and joint detection unit 110 according to one embodiment of the invention may modify the photographed image of the user's golf swing and determine the positions of the plurality of key points for the shaft of the club, the positions of the plurality of key points for the face of the club, and the position of the at least one joint of the user on the basis of a plurality of key points for the shaft detected from the modified image, a plurality of key points for the face detected from the modified image, and at least one joint of the user detected from the modified image, respectively.

Specifically, the club and joint detection unit 110 according to one embodiment of the invention may modify at least some frames contained in the photographed image of the user's golf swing. According to one embodiment of the invention, the modification may include flipping a frame left or right, shifting a position of a frame (or positions of at least some objects contained in the frame), and the like. Further, the club and joint detection unit 110 according to one embodiment of the invention may detect at least one of a plurality of key points for the shaft of the club and a plurality of key points for the face of the club, and at least one joint of the user from the photographed image of the user's golf swing modified as above. Furthermore, the club and joint detection unit 110 according to one embodiment of the invention may determine positions of at least one of the plurality of key points for the shaft of the club and the plurality of key points for the face of the club, and a position of the at least one joint of the user with reference to both a result of detection from the modified photographed image of the user's golf swing and a result of detection from the original photographed image of the user's golf swing (e.g., with reference to an average value of the heat map generated from each image), thereby increasing the detection accuracy of the artificial neural network model.

However, the method of modifying a frame or the number of modifications according to one embodiment of the invention is not limited to the foregoing, and may be diversely changed and/or combined as long as the objects of the invention may be achieved.

According to one embodiment of the invention, the frame to be modified as above may be a frame of high importance for analyzing the user's golf swing (e.g., a frame related to back swing top). Further, the club and joint detection unit 110 according to one embodiment of the invention may determine the frame to be modified as above with reference to at least one of a plurality of key points for the shaft of the club and a plurality of key points for the face of the club, and at least one joint of the user, which are first detected from the photographed image of the user's golf swing.

Further, the club and joint detection unit 110 according to one embodiment of the invention may increase the detection accuracy of the artificial neural network model by performing multiple detections from the photographed image of the user's golf swing and referring to all results of the detections. To this end, for example, an ensemble technique such as Random Forest or AdaBoost may be utilized.

Next, the golf swing information estimation unit 120 according to one embodiment of the invention may function to estimate a posture of the club on the basis of at least one of positions of the plurality of key points for the shaft of the club and positions of the plurality of key points for the face of the club.

Specifically, the golf swing information estimation unit 120 according to one embodiment of the invention may estimate a posture of the club on the basis of at least one of a positional relationship between the plurality of key points for the shaft of the club and a positional relationship between the plurality of key points for the face of the club. Here, according to one embodiment of the invention, the posture of the club may include, but is not limited to, a posture of the shaft of the club, a posture of the face of the club, and the like, and the posture of the shaft may include, but is not limited to, a position or orientation of the shaft, an angle formed by the shaft and a specific reference line (e.g., a reference line for the user's body), and the like.

Further, the golf swing information estimation unit 120 according to one embodiment of the invention may estimate the posture of the club on the basis of probability information on at least two of an arbitrary point located at an upper part of the shaft of the club, an arbitrary point located at a lower part of the shaft, and a point between the arbitrary point located at the upper part and the arbitrary point located at the lower part.

For example, referring to FIG. 3A, it may be assumed that the club and joint detection unit 110 according to one embodiment of the invention has detected an arbitrary point 313 located at an upper part of a shaft of a club, an arbitrary point 311 located at a lower part of the shaft, and a middle point 312 of the shaft from a photographed image of the user's golf swing as a plurality of key points for the shaft, and that probability for a position of the arbitrary point 311 located at the lower part is greater than a predetermined threshold. In this case, the golf swing information estimation unit 120 according to one embodiment of the invention may estimate the posture of the club (or the orientation of the club) from a part from the arbitrary point 313 located at the upper part of the shaft of the club to the arbitrary point 311 located at the lower part of the shaft.

As another example, referring to FIG. 3A, it may be assumed that the club and joint detection unit 110 according to one embodiment of the invention has detected an arbitrary point 313 located at an upper part of a shaft of a club, an arbitrary point 311 located at a lower part of the shaft, and a middle point 312 of the shaft from a photographed image of the user's golf swing as a plurality of key points for the shaft, and that probability for a position of the arbitrary point 311 located at the lower part is not greater than a predetermined threshold, and probability for a position of the middle point 312 is greater than the predetermined threshold. In this case, the golf swing information estimation unit 120 according to one embodiment of the invention may estimate the posture of the club (or the orientation of the club) from a part from the arbitrary point 313 located at the upper part of the shaft of the club to the middle point 312.

As yet another example, referring to FIG. 3B, it may be assumed that the club and joint detection unit 110 according to one embodiment of the invention has detected an arbitrary point 322 located at an upper part of a shaft of a club and a middle point 321 of the shaft from a photographed image of the user's golf swing as a plurality of key points for the shaft, and that probability for a position of the middle point 321 is greater than a predetermined threshold. In this case, the golf swing information estimation unit 120 according to one embodiment of the invention may estimate the posture of the club (or the orientation of the club) from a part from the arbitrary point 322 located at the upper part of the shaft of the club to the middle point 321.

Figure 5:
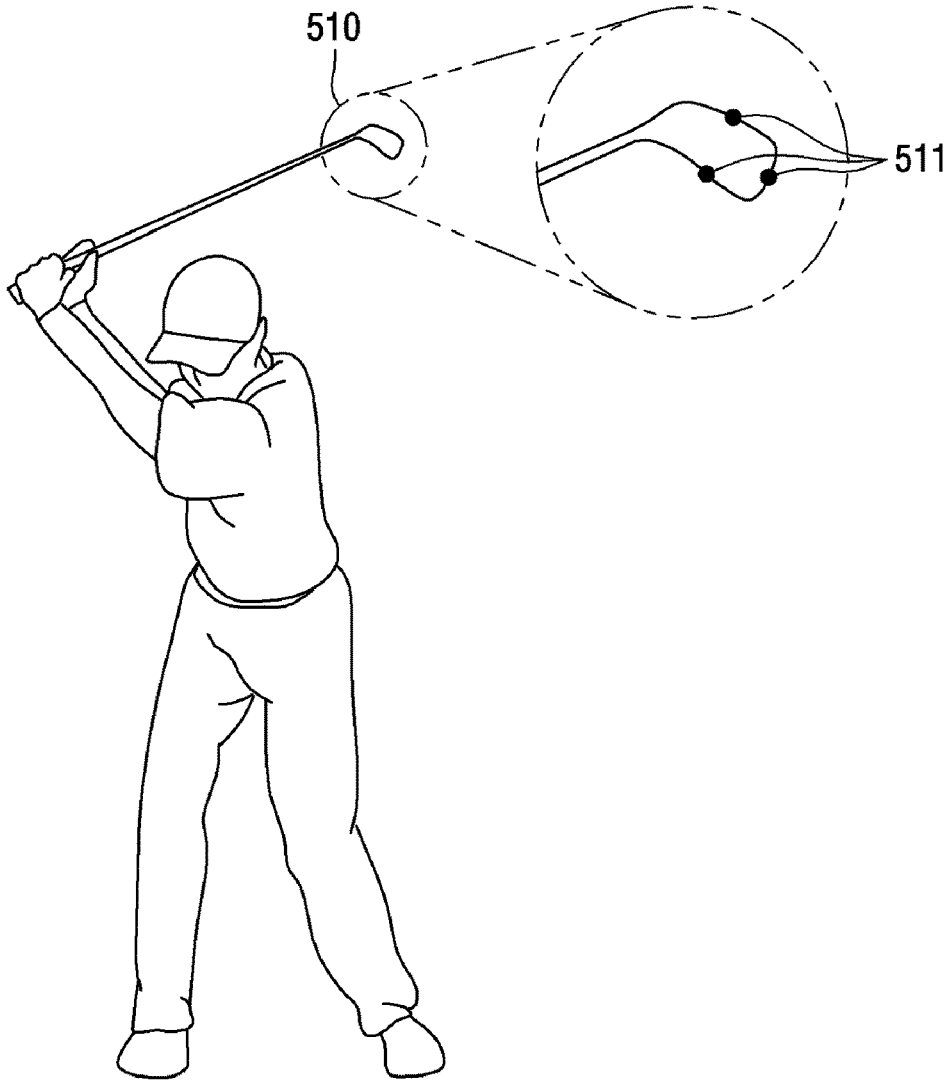
FIG. 5 illustratively shows how to estimate a posture of a club and information on a user's golf swing according to one embodiment of the invention.

FIG. 5 illustratively shows how to estimate a posture of a club and information on a user's golf swing according to one embodiment of the invention.

For example, referring to FIG. 5, the club and joint detection unit 110 according to one embodiment of the invention may detect a plurality of key points 511 for a face 510 of the club from a photographed image of the user's golf swing. Further, the golf swing information estimation unit 120 according to one embodiment of the invention may estimate a posture of the face 510 of the club (e.g., an orientation of the face, an angle formed by the face and a specific reference line (e.g., a reference line for the user's body), and a degree to which the club is open and closed during the golf swing) on the basis of a positional relationship between the plurality of key points 511 (e.g., a shape or area of a surface formed by the plurality of key points).

Further, the golf swing information estimation unit 120 according to one embodiment of the invention may function to estimate information on the user's golf swing with reference to the estimated posture of the club and a position of the at least one joint of the user.

Specifically, the golf swing information estimation unit 120 according to one embodiment of the invention may estimate at least one of a type of the at least one joint of the user, a position of the at least one joint of the user, a distance between the at least one joint of the user and at least one other joint of the user, and an angle formed between the at least one joint of the user and at least one other joint of the user on the basis of the position of the at least one joint of the user, and estimate a posture of the user on the basis thereof. Further, the golf swing information estimation unit 120 according to one embodiment of the invention may estimate information on the user's golf swing on the basis of the estimated posture of the user and the posture of the club.

Here, according to one embodiment of the invention, the information on the user's golf swing may include information that is difficult to identify only from the position of the at least one joint of the user, i.e., information on wrist control, club control, and the like. For example, according to one embodiment of the invention, the information on the user's golf swing may include information on a swing plane (e.g., whether the golf swing is a one-plane swing, two-plane swing, or shallow swing), information on cocking (e.g., whether early cocking, cocking, overswing, casting, or scooping has occurred), information on a club path during a back swing (e.g., whether the club is taken inward or outward), and information on a club face (e.g., whether the club is closed or open at the time of takeback or back swing top). However, the information on the user's golf swing according to one embodiment of the invention is not limited to those listed above, and may be diversely changed as long as the objects of the invention may be achieved.

Meanwhile, according to one embodiment of the invention, the information on the user's golf swing may be estimated separately for each partial motion constituting the golf swing.

Specifically, the golf swing according to one embodiment of the invention may be composed of eight stages of partial motions such as an address, a takeaway, a back swing, a top-of-swing, a down swing, an impact, a follow-through, and a finish. Further, the golf swing information estimation unit 120 according to one embodiment of the invention may function to derive to which of the above eight stages the photographed image of the user's golf swing corresponds, with reference to the posture of the club and the position of the at least one joint of the user, and estimate the information on the user's golf swing separately for each partial motion constituting the golf swing.

Meanwhile, the golf swing according to one embodiment of the invention is not necessarily separated into the eight stages as described above. That is, it may be separated to further include detailed stages constituting each of the eight stages, or such that at least some of the eight stages constitute one stage.

Figure 6:
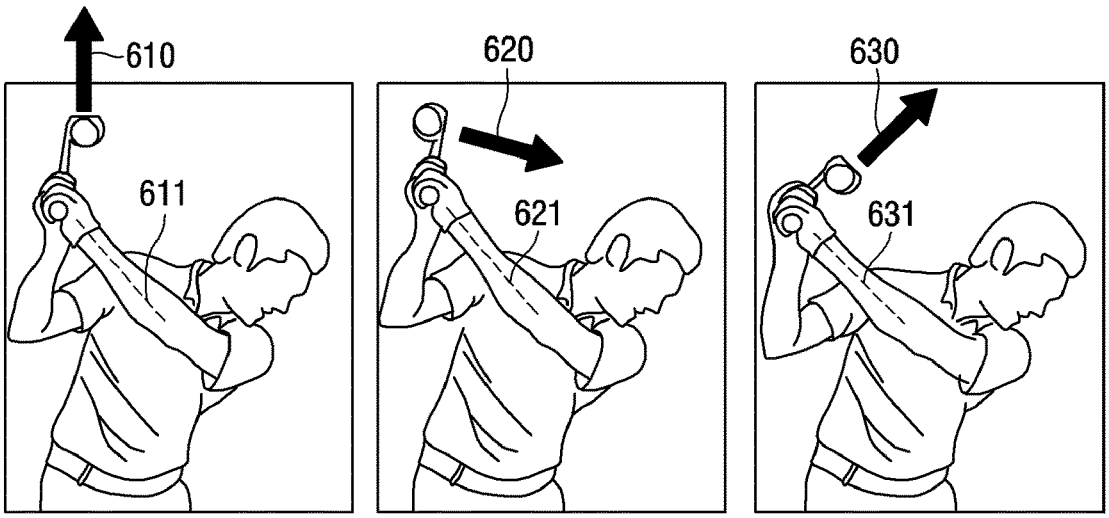
FIG. 6 illustratively shows how to estimate a posture of a club and information on a user's golf swing according to one embodiment of the invention.
Figure 7:
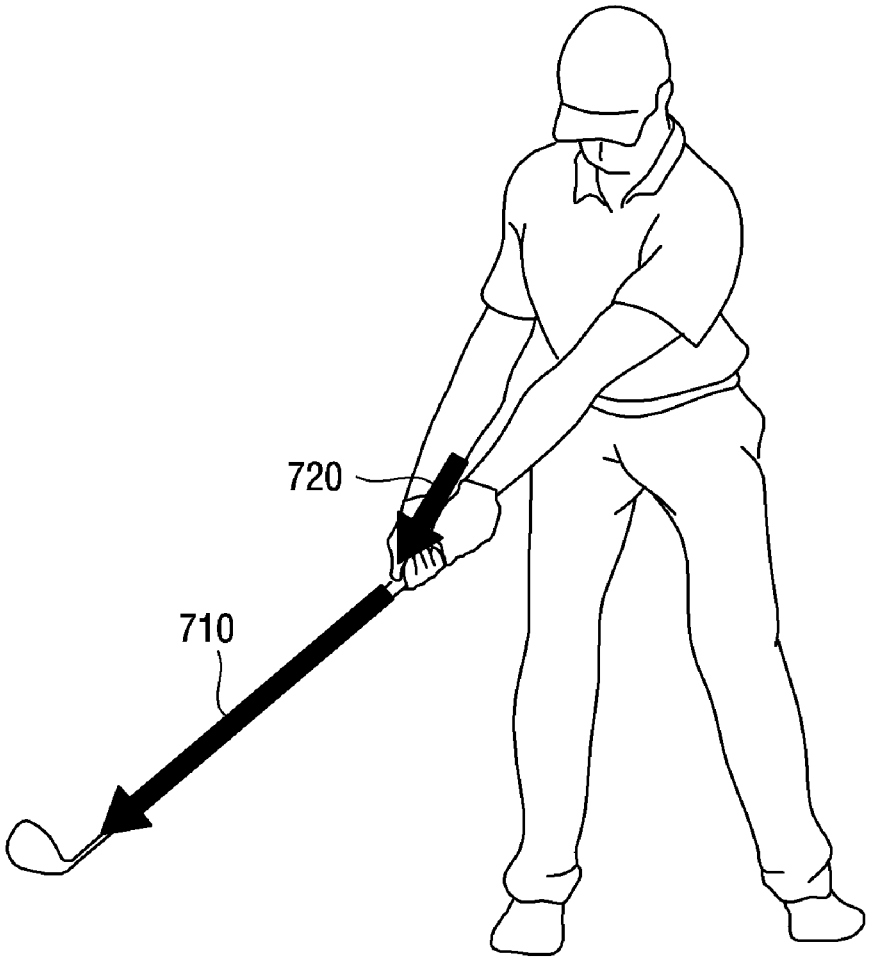
FIG. 7 illustratively shows how to estimate a posture of a club and information on a user's golf swing according to one embodiment of the invention.

FIGS. 6 and 7 illustratively show how to estimate a posture of a club and information on a user's golf swing according to one embodiment of the invention.

For example, referring to FIG. 6, the golf swing information estimation unit 120 according to one embodiment of the invention may estimate the information on the user's golf swing with reference to an angle (or orientation) of the user's arm 611, 621, 631 (i.e., a posture of the user), which may be estimated on the basis of a position of at least one joint of the user, and a posture of a face of the club 610, 620, 630 (e.g., an orientation of the face), which may be estimated on the basis of a plurality of key points for the face of the club.

As another example, referring to FIG. 7, the golf swing information estimation unit 120 according to one embodiment of the invention may estimate the information on the user's golf swing with reference to an orientation (or angle) of the user's wrist 720 (i.e., a posture of the user), which may be estimated on the basis of a position of at least one joint of the user, and a posture of a shaft of the club 710 (e.g., an orientation of the shaft), which may be estimated on the basis of a plurality of key points for the shaft of the club.

Next, the communication unit 130 according to one embodiment of the invention may function to enable data transmission/reception from/to the club and joint detection unit 110 and the golf swing information estimation unit 120.

Lastly, the control unit 140 according to one embodiment of the invention may function to control data flow among the club and joint detection unit 110, the golf swing information estimation unit 120, and the communication unit 130. That is, the control unit 140 according to one embodiment of the invention may control data flow into/out of the device 100 or data flow among the respective components of the device 100, such that the club and joint detection unit 110, the golf swing information estimation unit 120, and the communication unit 130 may carry out their particular functions, respectively.

The embodiments according to the invention as described above may be implemented in the form of program instructions that can be executed by various computer components, and may be stored on a computer-readable recording medium. The computer-readable recording medium may include program instructions, data files, and data structures, separately or in combination. The program instructions stored on the computer-readable recording medium may be specially designed and configured for the present invention, or may also be known and available to those skilled in the computer software field. Examples of the computer-readable recording medium include the following: magnetic media such as hard disks, floppy disks and magnetic tapes; optical media such as compact disk-read only memory (CD-ROM) and digital versatile disks (DVDs); magneto-optical media such as floptical disks; and hardware devices such as read-only memory (ROM), random access memory (RAM) and flash memory, which are specially configured to store and execute program instructions. Examples of the program instructions include not only machine language codes created by a compiler, but also high-level language codes that can be executed by a computer using an interpreter. The above hardware devices may be changed to one or more software modules to perform the processes of the present invention, and vice versa.

Although the present invention has been described above in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A method performed in a device for estimating information on a golf swing, the device comprising one or more processors and the method comprising the steps of:

by the one or more processors, detecting, when a photographed image of a user's golf swing is acquired, a plurality of key points for a shaft of a club and a plurality of key points for a face of the club, and at least one joint of the user from the photographed image using an artificial neural network model; and by the one or more processors, estimating a posture of the club on the basis of positions of the plurality of key points for the shaft and positions of the plurality of key points for the face, and estimating information on the user's golf swing with reference to the posture of the club and a position of the at least one joint of the user, wherein in the detecting step, probability information on the positions of at least one of the plurality of key points for the shaft and the plurality of key points for the face, and probability information on the position of the at least one joint of the user are derived from the photographed image using the artificial neural network model, wherein at least one of the probability information on the positions of the plurality of key points for the shaft, the probability information on the positions of the plurality of key points for the face, and the probability information on the position of the at least one joint of the user is included in a probability map generated by using the photographed image as input data of the artificial neural network model, wherein in the detecting step, at least some frames contained in the photographed image are modified, and the plurality of key points for the shaft and the plurality of key points for the face, and the at least one joint of the user are detected from the modified photographed image using the artificial neural network model, and wherein in the detecting step, the positions of the plurality of key points for the shaft and the positions of the plurality of key points for the face, and the position of the at least one joint of the user are determined with reference to both a result of the detection from the unmodified photographed image and a result of the detection from the modified photographed image.

2. The method of claim 1, wherein in the estimating step, the posture of the club is estimated on the basis of probability information on at least two of an arbitrary point located at an upper part of the shaft, an arbitrary point located at a lower part of the shaft, and a point between the arbitrary point located at the upper part and the arbitrary point located at the lower part.

3. The method of claim 1, wherein in the detecting step, the plurality of key points and the at least one joint of the user are detected from the photographed image multiple times using different artificial neural network models, and wherein in the estimating step, the information on the user's golf swing is estimated with reference to all results of the multiple detections.

4. The method of claim 1, wherein the artificial neural network model is light-weighted using depthwise convolution and pointwise convolution.

5. The method of claim 1, wherein in the estimating step, at least one of a type of the at least one joint of the user, a distance between the at least one joint of the user and at least one other joint of the user, and an angle formed between the at least one joint of the user and at least one other joint of the user is estimated on the basis of the position of the at least one joint of the user.

6. A non-transitory computer-readable recording medium having stored thereon a computer program for executing the method of claim 1.

7. A device for estimating information on a golf swing, the device comprising one or more processors configured to:

detect, when a photographed image of a user's golf swing is acquired, a plurality of key points for a shaft of a club and a plurality of key points for a face of the club, and at least one joint of the user from the photographed image using an artificial neural network model; and estimate a posture of the club on the basis of positions of the plurality of key points for the shaft and positions of the plurality of key points for the face, and estimate information on the user's golf swing with reference to the posture of the club and a position of the at least one joint of the user, wherein the one or more processors are configured to derive probability information on the positions of at least one of the plurality of key points for the shaft and the plurality of key points for the face, and probability information on the position of the at least one joint of the user from the photographed image using the artificial neural network model, wherein at least one of the probability information on the positions of the plurality of key points for the shaft, the probability information on the positions of the plurality of key points for the face, and the probability information on the position of the at least one joint of the user is included in a probability map generated by using the photographed image as input data of the artificial neural network model, wherein the one or more processors are configured to modify at least some frames contained in the photographed image, and detect the plurality of key points for the shaft and the plurality of key points for the face, and the at least one joint of the user from the modified photographed image using the artificial neural network model, and wherein the one or more processors are configured to determine the positions of the plurality of key points for the shaft and the positions of the plurality of key points for the face, and the position of the at least one joint of the user with reference to both a result of the detection from the unmodified photographed image and a result of the detection from the modified photographed image.

8. The device of claim 7, wherein the one or more processors are configured to estimate the posture of the club on the basis of probability information on at least two of an arbitrary point located at an upper part of the shaft, an arbitrary point located at a lower part of the shaft, and a point between the arbitrary point located at the upper part and the arbitrary point located at the lower part.

9. The device of claim 7, wherein the one or more processors are configured to detect the plurality of key points and the at least one joint of the user from the photographed image multiple times using different artificial neural network models, and wherein the one or more processors are configured to estimate the information on the user's golf swing with reference to all results of the multiple detections.

10. The device of claim 7, wherein the artificial neural network model is light-weighted using depthwise convolution and pointwise convolution.

11. The device of claim 7, wherein the one or more processors are configured to estimate at least one of a type of the at least one joint of the user, a distance between the at least one joint of the user and at least one other joint of the user, and an angle formed between the at least one joint of the user and at least one other joint of the user on the basis of the position of the at least one joint of the user.

* * * * *